United States Patent [19]

Ackeret et al.

[11] Patent Number: 4,993,122

[45] Date of Patent: Feb. 19, 1991

[54] NIPPER FOR A COMBING MACHINE USING BONDED FIBER MATERIAL

[75] Inventors: Walter Ackeret, Seuzach; Gian-Carlo Mondini, Winterthur, both of Switzerland

[73] Assignee: Reiter Machine Works, Ltd., Winterthur, Switzerland

[21] Appl. No.: 432,804

[22] Filed: Nov. 6, 1989

[30] Foreign Application Priority Data

Nov. 4, 1988 [CH] Switzerland ..... 04101/88

[51] Int. Cl.[5] ..... D01G 19/16

[52] U.S. Cl. ..... 19/225; 19/226; 19/235

[58] Field of Search ..... 19/225, 226, 235; 139/185, 91, 92, 157

[56] References Cited

U.S. PATENT DOCUMENTS

| | | | |
|---|---|---|---|
| 1,889,435 | 11/1932 | Crockett | 19/225 |
| 1,905,336 | 4/1933 | Blanchard | 19/225 |
| 3,103,041 | 9/1963 | Nydam | 19/225 |
| 3,754,577 | 8/1973 | Heller | 139/92 |
| 3,960,182 | 6/1976 | Schwarz | 139/91 |
| 4,130,141 | 12/1978 | Alley | 139/157 |
| 4,476,900 | 10/1984 | Bowen | 139/91 |
| 4,672,717 | 6/1987 | Shimomura | 19/225 |
| 4,790,357 | 12/1988 | Kramer | 139/91 |
| 4,832,089 | 5/1989 | Riesen et al. | 139/185 |

FOREIGN PATENT DOCUMENTS

| | | |
|---|---|---|
| 1179138 | 10/1964 | Fed. Rep. of Germany . |
| 1203890 | 1/1960 | France . |
| 2141151 | 12/1984 | United Kingdom . |

*Primary Examiner*—Werner H. Schroeder
*Assistant Examiner*—John J. Calvert
*Attorney, Agent, or Firm*—Kenyon & Kenyon

[57] ABSTRACT

The nipper has a lower jaw which carries a nipper plate and an upper jaw with a nipper plate carried by two arms. At least a part of this nipper, e.g. the lower nipper plate and the upper nipper plate are made from bonded fiber material. In this way, the unit is lighter than a unit which is made completely from metal.

25 Claims, 4 Drawing Sheets

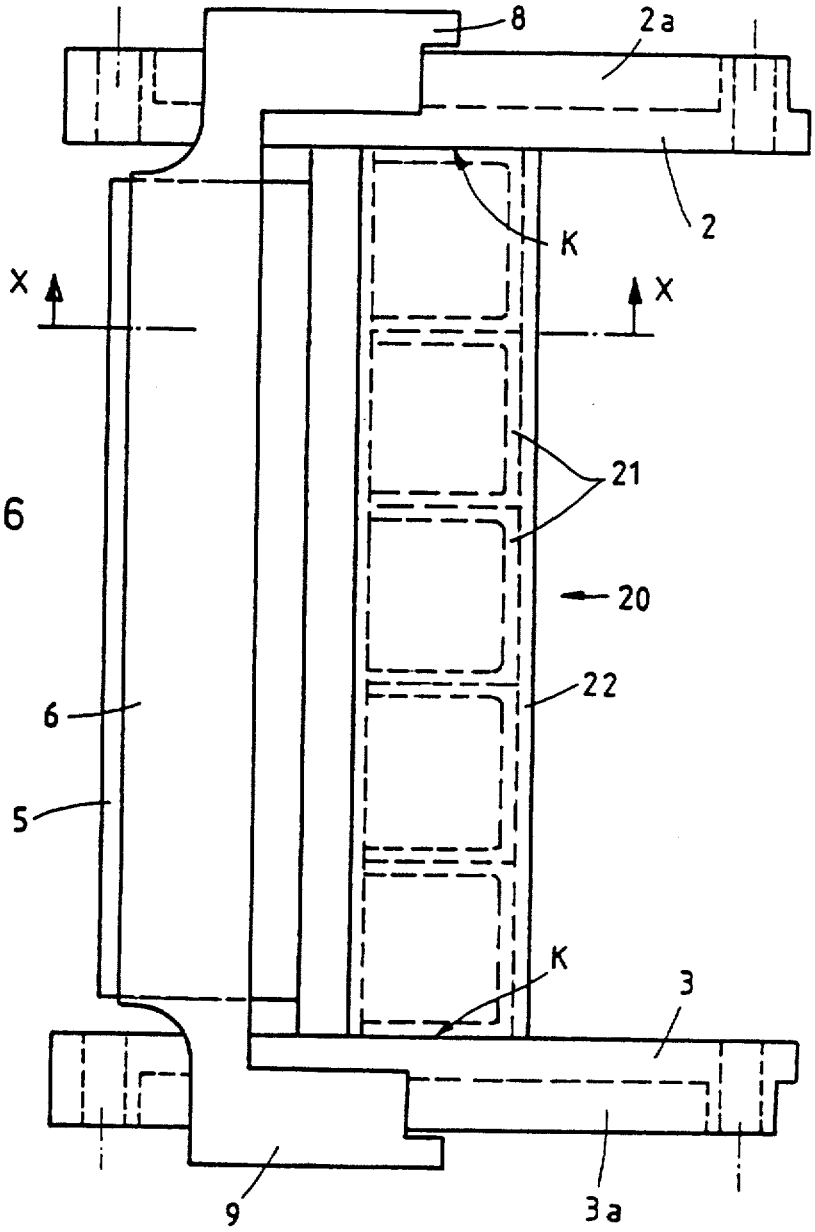
Fig. 6
Fig. 7
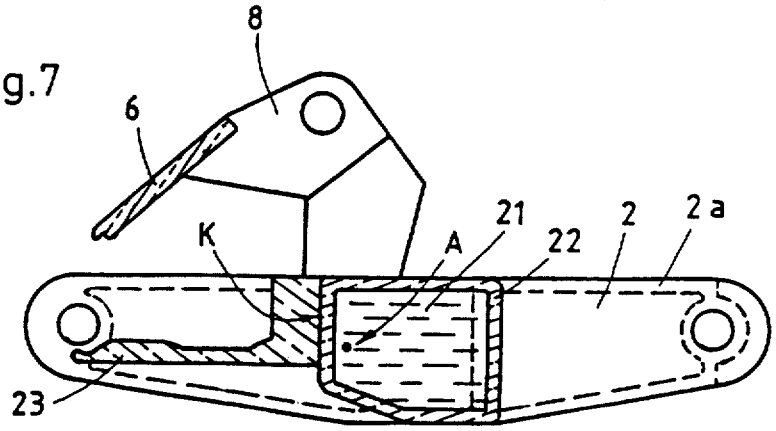

NIPPER FOR A COMBING MACHINE USING BONDED FIBER MATERIAL

This invention relates to a nipper for a combing machine.

As is known, for example from U.K. Patent Application No. 2141151 and German Patent No. 1,179,138, nippers for combing machines have been constructed with a lower jaw and an upper jaw which can be moved relative to each other in order to deliver tufts from a delivered lap to a carding cylinder. Generally, the lower jaw includes a nipper plate which is mounted by a pair of side arms on a frame which can be oscillated back and forth by a suitable drive while the upper jaw has a nipper plate pivotally mounted by a pair of side arms on the lower jaw. In a customary combing machine, such a nipper oscillates between a retracted position and an advanced position during a so called nip. In the retracted position, the nipper is closed, that is, the forward edge of the upper nipper plate is pressed against the forward edge of the lower nipper plate in order to clamp a fiber tuft firmly which tuft is then combed out by a rotating comb cylinder.

At the present time, combing machines operate with nip figures up to about 100 per minute. Any further increase of the nip figure depends, amongst other things, on the relatively large mass to be moved as the nippers, as a rule, are made of metal.

Accordingly, it is an object to the invention to reduce the mass of a nipper.

It is another object to the invention to provide an improved nipper for use at high nip speeds.

It is another object to the invention to be able to operate a nipper at high nip speeds without the appearance of undesirable heavy vibrations.

Briefly, the invention is directed to a nipper for a combing machine comprised of a lower jaw having a pair of parallel side arms and a lower nipper plate mounted on the side arms as well as an upper jaw having a pair of parallel side arms pivotally mounted on the side arms of the lower jaw and an upper nipper plate mounted on the side arms of the upper jaw. In accordance with the invention, at least one of the components of the nipper, that is, one of the nipper plates and the side arms is made of bonded fiber material. For this purpose, at least the upper nipper plate and/or the lower nipper plate can be made at least partly from bonded fiber material. The nipper plates can have essentially the same dimensions as the known nipper plates made only from steel.

As the density of the bonded fiber material is considerably less than that of steel, the nipper plates can be correspondingly lighter in weight. Despite this lighter weight, with suitable bonded fiber materials, especially carbon fiber or aramide or paramide bonded fiber material, the required strength of the nipper plates can be obtained without problems. In order to ensure adequate wearing resistance in the region of the front edges of the nipper plates, that is, in the region of the clamping edges, the nipper plates in this region can be coated with metal. Instead of this, the nipper may be constructed from a bonded fiber carrier plate bonded fiber and a steel clamping strip.

For the movement of the lower jaw driving arms are connected to the side arms of the lower jaws in a hinged manner. Expediently, these driving arms are also made, at least in part, from bonded fiber material.

In the area of the application of forces, e.g. at the support positions of the side arms of the lower the construction of a reasonable and economical version with composite material is very difficult, especially in those positions where mechanical finishing is required. Thus, in one embodiment, the side arms are manufactured from metal, for example, from diecast aluminum, and are connected with each other over a crossbar of bonded fiber material by an adhesive joint.

For the longitudinal and transverse stabilization and for an increase in the torsional strength of the transverse connection, the crossbar should be made from bonded fiber profiles, for example, a compact unit over a further bonded fiber material common support. In this way, it is possible to manufacture a ribbed crossbar from bonded fiber material.

These and other objects and advantages of the invention will become more apparent from the following detailed description taken in conjunction with the accompanying drawings wherein:

FIG. 6 illustrates a top view of a further nipper in accordance with the invention; and FIG. 7 illustrates a view taken on line x—x of FIG. 6.

Figure 1:
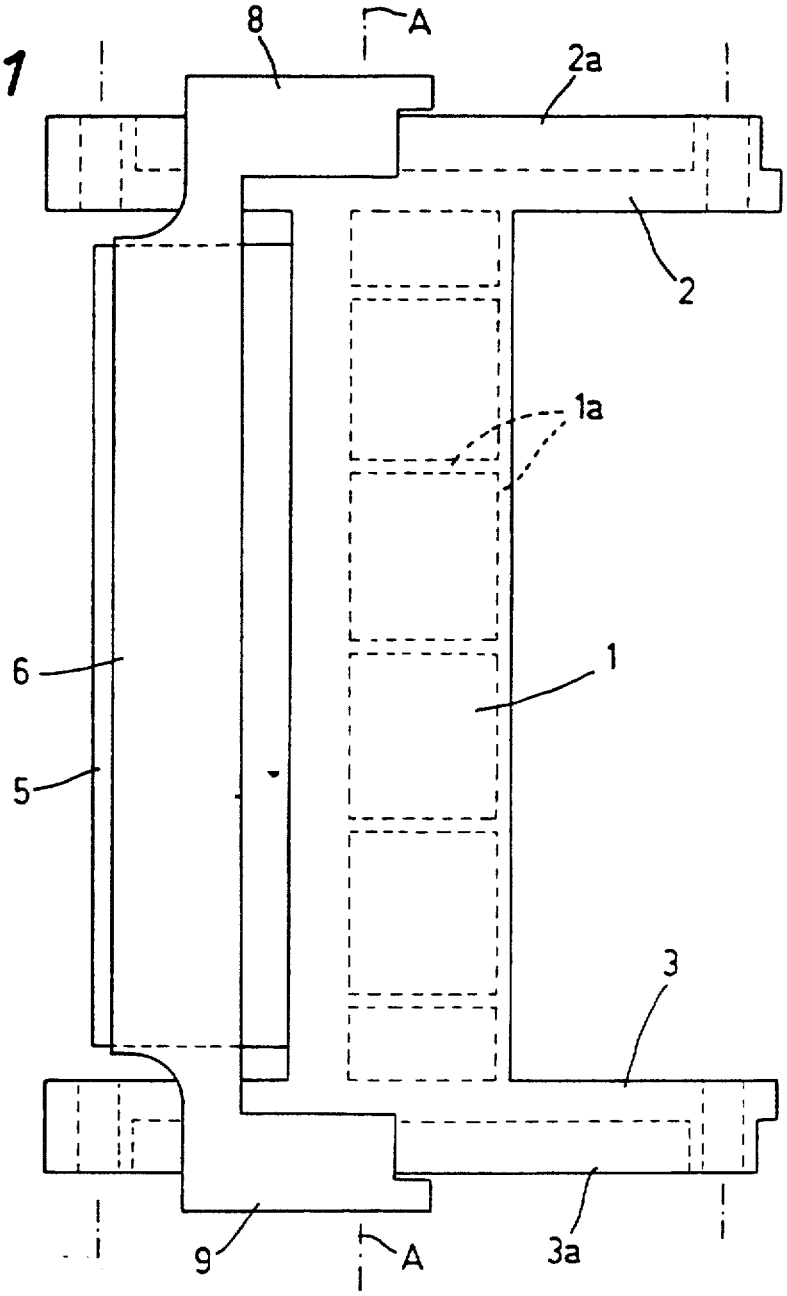
FIG. 1 illustrates a top view of a nipper constructed in accordance with the invention.
Figure 2:
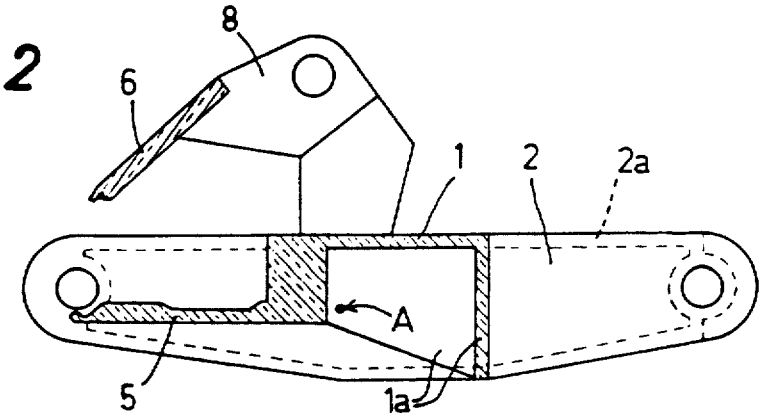
FIG. 2 illustrates a cross sectional view of a nipper of FIG. 1.

Referring to FIGS. 1 and 2, the nipper has a lower jaw and an upper jaw mounted on the lower jaw. As shown, the lower jaw has a lower nipper frame which consists of a two side arms 2, 3 connected by a crossbar 1 which, in turn, carries a lower nipper plate 5 which extends forwardly. The upper jaw has a nipper frame which consists of an upper nipper plate 6 carried by two arms 8, 9 which are connected to swivel on an axis A with the nipper frame 1, 2, 3.

In order to ensure that the nipper should be as light as possible, the various parts, i.e. the crossbar 1, the side arms 2, 3, the lower nipper plate 5, the upper nipper plate 6 and the swivelling arms 8, 9, are made from bonded fiber material. The bonded fiber material is a plastic reinforced with fibers, in particular carbon fibers, or aramide or para-aramide fibers, ("KEVLAR" fibers), which have high strength The crossbar 1 and the sidearms 2, 3 are also provided with strengthening (reinforcing) ribs 1*a*, 2*a* or 3*a*. The swivelling arms 8, 9 of the upper nipper can have similar reinforcing ribs (not shown).

The bonded fiber materials can have a high modulus of elasticity, which is comparable with that of steel, e.g., about 200 $kN/mm^2$ measured in the direction in which the least part of the reinforcing fibers run in the material.

It is, however, also possible to use a bonded fiber material with a considerably lower modulus of elasticity for the lower nipper plate 5 and/or the upper nipper plate 6, for example, with a modulus of elasticity of from 10 to 80 $kN/mm^2$, e.g. from about 25 $kN/mm^2$, again measured in the direction in which the least part of the reinforcing fibers run in the material. In the nipper plates 5 and 6, it is expedient if at least a part of the reinforcing fibers runs in the direction from front to back, that is perpendicular to the front edges (clamping edges) of the nipper plates. A nipper plate made from such a bonded fiber material with a relatively low modulus of elasticity can then be elastically bent in operation, through the clamping force, e.g. 12 to 15 N/cm, with which the front edges of the nipper plates 5, 6 are pressed together when the nipper is closed. For example, each plate 5, 6 may deflect 0.5 millimeters at the front edge. With bending of this kind, the noise developed when the nipper is closed can be reduced, as a part of the mechanical energy due to the closing of the nipper is temporarily stored in the elastic deformation of the plates 5, 6 and is only released when the nipper is opened. This consideration also holds good for the other forms of construction described in the following.

For the form of construction according to FIG. 1 and 2, the components of the lower jaw, that is, the lower nipper frames 1, 2, 3 and the lower nipper plate 5 are constructed as one piece. Likewise, the jaw components 6, 8, 9 are constructed as one piece. Naturally, it would also be feasible to produce one or both of the nipper plates 5, 6 specially and then to fasten them onto the nipper frames 1, 2, 3 or on the swivelling side arms on, for example, similar to the construction form according to FIGS. 3 and 4.

Figure 3:
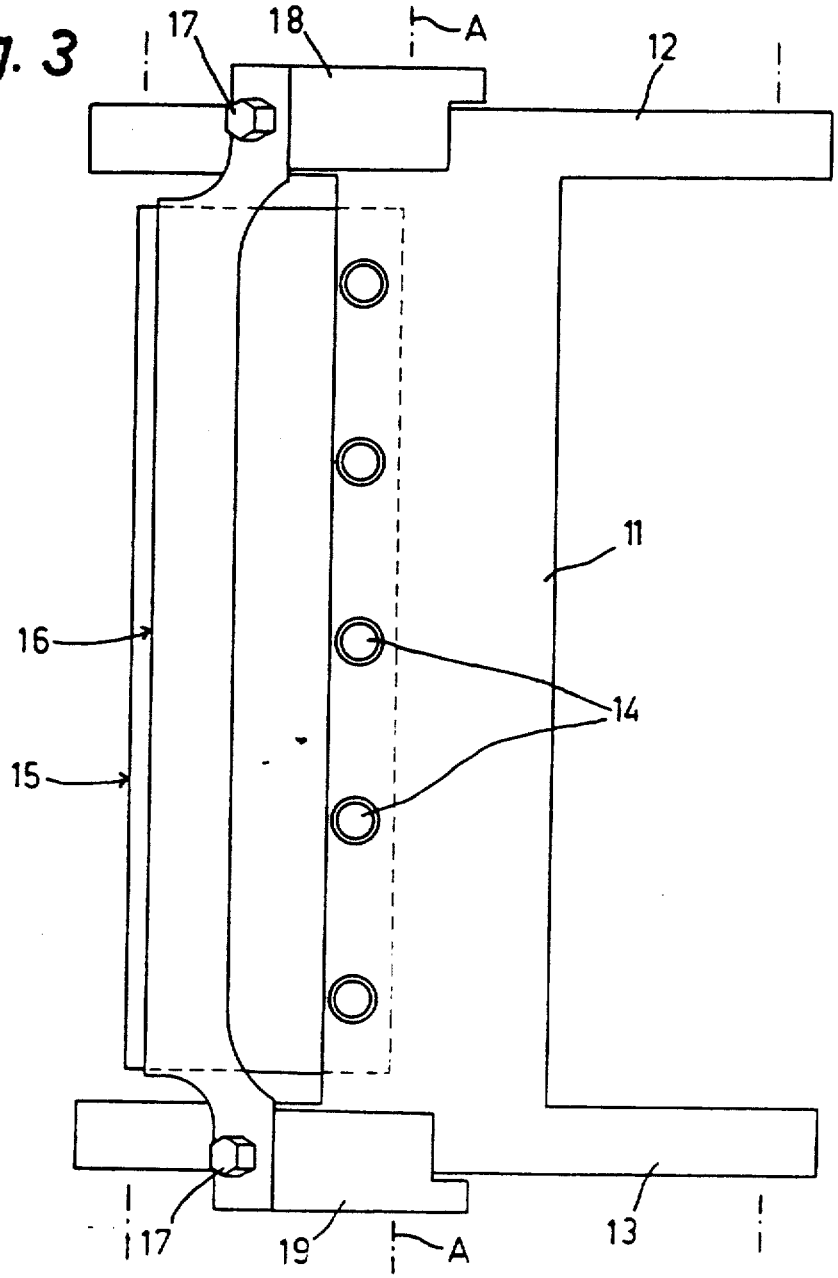
FIG. 3 illustrates a top view of a modified nipper constructed in accordance with the invention.
Figure 4:
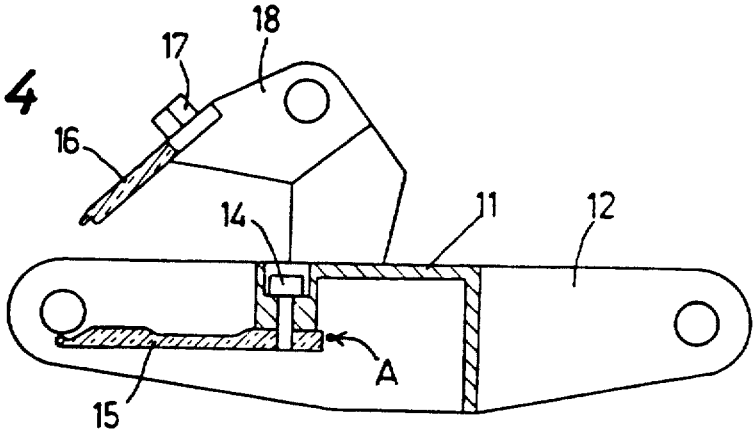
FIG. 4 illustrates a side view of the nipper of FIG. 3.

Referring to FIGS. 3 and 4, the nipper may have a lower jaw which consists of two side arms 12, 13 connected together with a crossbar 11 while a lower nipper plate 15 is fastened, for example, with screws 14 to the crossbar 11 and extends forwardly. An upper nipper plate 16 is fastened, e.g. with screws 17, on two arms 18, 19, which have a swivel connection on a common axis A with the lower nipper frame 11, 12, 13. The lower nipper plate 15 and the upper nipper plate 16 are made from bonded fiber material, as described above, whilst the lower nipper frames 11, 12, 13 and the swivelling arms 18, 19 are made from metal, if desired.

The front or clamping edges of the two nipper plates 15, 16 are formed in the normal way, in that they grip onto each other and bend a firmly held fiber tuft downwards when the nipper is closed.

The required form of the front edges in the bonded fiber material nipper plates 15, 16 can be produced through metal machining, in particular, by milling. It is, however, better, especially with the under nipper plate 15, when a depression is required on the front edge, to produce the plates by stamping or pressing during the manufacture of the plates before the bonded fiber material hardens. In this way, a separation of the reinforcing fibers of the bonded fiber material can be avoided, which would lead to an additional impairment of the strength.

The lower nipper plate 15 and the upper nipper plate 16 can be coated with metal (not shown) in the region of their front edges in order to increase the wearing resistance. Naturally, this also applies to the form of construction according to FIG. 1 and FIG. 2.

Figure 5:
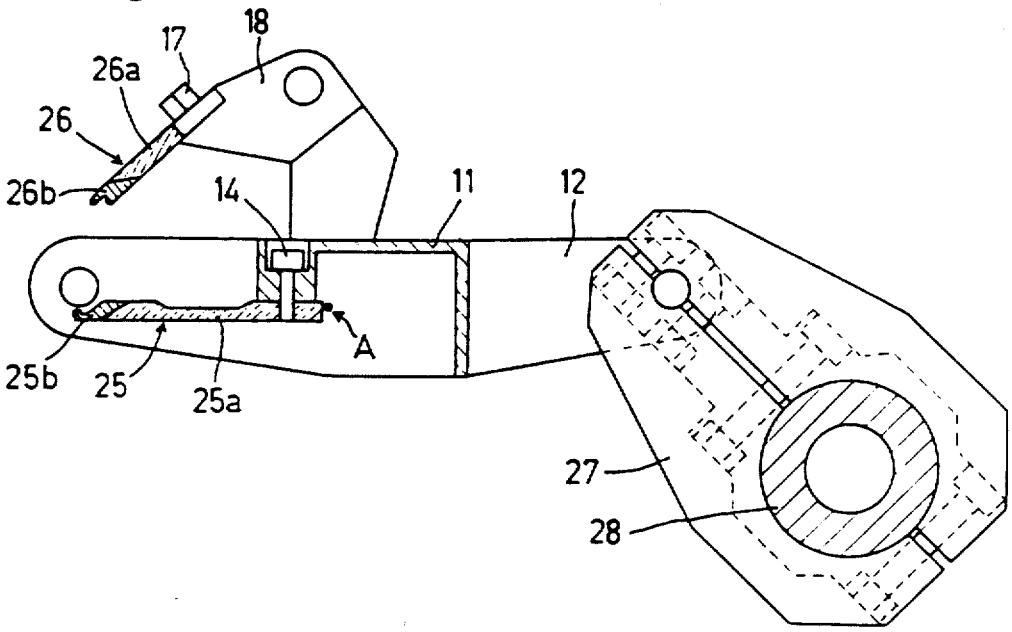
FIG. 5 illustrates a view similar to FIG. 4 of a further modified nipper in accordance with the invention.

Referring to FIG. 5, the nipper plates can be assembled from two parts, namely a carrier plate of bonded fiber material and a clamping strip of metal, preferably steel. For example, the nipper plate 25 consists of a carrier plate 25*a* of bonded fiber material, which is fastened to the crossbar 11, and a steel clamping strip 25*b* fastened or stuck fast to the carrier plate 25*a*. Similarly, the upper nipper plate 26 consists of a carrier plate 26*a* of bonded fiber material which is fastened on the arms 18, 19 (FIG. 3) and a clamping strip 26*b* of steel, which is fastened, or stuck fast, on the carrier plate 26*a*.

In FIG. 5, one of the two nipper driving (operating) arms 27 is shown on which the side arms 12, 13 of the lower jaw are swivelled. The nipper driving arms 27 are positioned in the normal way on a nipper shaft 28 to move the lower nipper plate 25 to and fro during the operation of the machine. These swivelling nipper driving arms 27 may also be made from bonded fiber material, at least in part, with the possible exception of bearing bushes.

The oscillating nipper shaft 28 can also be made from bonded fiber material.

Referring to FIGS. 6 and 7, wherein like reference characters indicate like parts as above, the lower jaw is not made as a whole with a lower nipper frame of bonded fiber material, but rather with side arms 2, 3 of metal material, e.g. diecast aluminum. In this embodiment, the crossbar 20, which connects the two side arms 2, 3 with each other over an adhesive joint K is also made from bonded fiber material or composite material.

In order to achieve increased bending strength as well as torsional strength, the crossbar 20 is provided with U-shaped profiles made from composite material joined with each other over a further bonded fiber material common support 22, so as to be assembled as a crossbar in one piece. This combination of bonded fiber material profiles is necessary since production of a honeycomb structure of that kind, with only one position, cannot be manufactured without problems. The nipper plate 23 is fastened on the crossbar 20 over an adhesive joint K. Through this combination of materials of the side arms 2, 3 and the crossbar 20, it is possible to construct the bearing positions for the application of the force in the lower nipper jaw with controllable technology, in such a way that it corresponds with the strength and functional requirements. On the other hand, the use of an appropriate crossbar, made from composite material, considerably reduces the weight of the lower nipper jaw, which brings the advantages already described.

The invention thus provides a nipper of relatively low mass and high strength which is capable of high nip speeds, for example of 360 per minute or about 400 per minute without the appearance of undesirable heavy vibrations.

What is claimed:

1. A nipper for a combing machine comprising a lower jaw having a pair of parallel side arms and a lower nipper plate mounted on said side arms; and an upper jaw having a pair of parallel side arms pivotally mounted on said side arms of said lower jaw and an upper nipper plate mounted on said side arms thereof wherein at least one component of said nipper plates and said pairs of said arms is made of bonded fiber material.

2. A nipper as set forth in claim 1 which further comprises an operating arm pivotally connected to and between said side arms of said lower jaw, said operating arm being made of bonded fiber material.

3. A nipper as set forth in claim 1 wherein the bonded fiber material is a carbon fiber bonded material.

4. A nipper as set forth in claim 1 wherein said bonded fiber material includes fibers selected from the group consisting of aramide and para-aramide fibers.

5. A nipper as set forth in claim 1 wherein said one component has a modulus of elasticity of from 10 to 80 $kN/mm^2$ measured in a direction in which at least part of the fibers extend.

6. A nipper as set forth in claim 1 wherein said one component has a modulus of elasticity of about 200 kN/mm² measured in a direction in which the least part of the fibers runs.

7. A nipper as set forth in claim 6 wherein at least a part of said upper nipper plate is made from bonded fiber material.

8. A nipper as set forth in claim 7 wherein said arms of said upper jaw are made at least in part from said bonded fiber material.

9. A nipper as set forth in claim 8 wherein said upper jaw is made of one piece.

10. A nipper as set forth in claim 1 wherein at least one said lower nipper plate is made at least in part from said bonded fiber material.

11. A nipper as set forth in claim 10 wherein said arms of said lower jaw are made from said bonded fiber material.

12. A nipper as set forth in claim 11 wherein said lower jaw is made of one piece.

13. A nipper as set forth in claim 1 wherein each of said plates has a metal coating on an end facing the other of said plates.

14. A nipper as set forth in claim 1 wherein at least one of said plate is a composite plate having a carrier plate made of bonded fiber material and a clamping strip made of metal and supported on one end of said carrier plate.

15. A nipper as set forth in claim 14 wherein each clamping strip is adhesively secured to a respective carrier plate.

16. A nipper as set forth in claim 1 wherein said lower jaw includes a crossbar of said bonded fiber material connected to and between said side arms of said lower jaw, said crossbar having said lower nipper plate secured thereto and wherein said side arms of said lower jaw are made of metal.

17. A nipper as set forth in claim 16 wherein said crossbar is made of a plurality of bonded fiber material profiles integrally secured to a common bonded fiber material support.

18. A nipper as set forth in claim 17 wherein said crossbar is adhesively secured to said side arms of said lower jaw.

19. A nipper for a combing machine comprising a lower jaw having a lower nipper plate of bonded fiber material; and an upper jaw having an upper nipper plate of bonded fiber material facing said lower nipper plate, said plates each having a modulus of elasticity of from 10 to 80 kN/mm² in the direction of the fibers thereof and being capable of elastically bending in response to impacting of said plates together.

20. A nipper as set forth in claim 19 wherein said lower jaw includes a pair of parallel side arms for connecting to an operating arm and a crossbar between said side arms supporting said lower nipper plate thereon.

21. A nipper as set forth in claim 20 wherein said lower nipper plate is integrally secured to said crossbar and said crossbar is made of said bonded fiber material.

22. A nipper as set forth in claim 21 wherein said crossbar is integral with said side arms of said lower jaw and said side arms are made of bonded fiber material.

23. A nipper as set forth in claim 19 wherein each jaw has a metal clamping strip carried on one end of said nipper plate thereof.

24. A nipper for a combing machine comprising a lower jaw having a pair of parallel side arms and a lower nipper plate mounted in said side arms, said plate being made of bonded fiber material and having a modulus of elasticity of from 10 to 80 kN/mm²; and an upper jaw having a pair of side arms pivotally mounted on said arms of said lower jaw and an upper nipper plate mounted on said side arms thereof, said upper plate being made of bonded fiber material and having a modulus of elasticity of from 10 to 80 kN/mm².

25. A nipper as set forth in claim 24 wherein each plate has a modulus of elasticity of about 25 kN/mm².

* * * * *

UNITED STATES PATENT AND TRADEMARK OFFICE

CERTIFICATE OF CORRECTION

PATENT NO. : 4,993,122

DATED : February 19, 1991

INVENTOR(S) : WALTER ACKERET, et al

It is certified that error appears in the above-identified patent and that said Letters Patent is hereby corrected as shown below:

Column 1, line 63 "carrier plate bonded fiber" should be -material-
Column 2, line 2 "lower" should be -lower jaw-
Line 36 "a two" should be -two-
Column 3, line 22 cancel "on" (second occurrence)
Column 5, line 24 change "plate" to -plates-

Signed and Sealed this

Eighth Day of September, 1992

*Attest:*

DOUGLAS B. COMER

*Attesting Officer*

*Acting Commissioner of Patents and Trademarks*